US009458639B1

(12) United States Patent
Coleman

(10) Patent No.: US 9,458,639 B1
(45) Date of Patent: Oct. 4, 2016

(54) METAL ROOF SAFETY ANCHOR DEVICE

(71) Applicant: Charles Coleman, Philadelphia, MS (US)

(72) Inventor: Charles Coleman, Philadelphia, MS (US)

( * ) Notice: Subject to any disclaimer, the term of this patent is extended or adjusted under 35 U.S.C. 154(b) by 0 days.

(21) Appl. No.: 14/632,533

(22) Filed: Feb. 26, 2015

(51) Int. Cl.
*E04G 21/32* (2006.01)
*E04D 13/12* (2006.01)

(52) U.S. Cl.
CPC ..... *E04G 21/3285* (2013.01); *E04D 13/12* (2013.01); *E04G 21/3214* (2013.01); *E04G 21/3276* (2013.01)

(58) Field of Classification Search
CPC ..... E04G 21/3214; E04G 21/3261; E04G 21/3276; E04G 21/328; E04G 21/3285; E04G 21/329; E04G 3/22; E04D 13/10; E04D 13/12
USPC ..... 248/237; 182/45, 3
See application file for complete search history.

(56) References Cited

U.S. PATENT DOCUMENTS

| | | | | |
|---|---|---|---|---|
| 4,249,713 | A | 2/1981 | Glynn et al. | |
| 5,896,719 | A | 4/1999 | Thornton | |
| 2012/0312633 | A1 | 12/2012 | Massey | |
| 2015/0225969 | A1 * | 8/2015 | O'Grady, Sr. | E04G 3/265 182/45 |

* cited by examiner

*Primary Examiner* — Ingrid M Weinhold
(74) *Attorney, Agent, or Firm* — Crossley & Stevenson Intellectual Property Law

(57) ABSTRACT

A safety anchor device attachable to a metal roof is provided in one-piece construction and is noninvasively attached to a metal roof. The device leaves no marks or flaws in or on the roof or roof structure. The device has a substantially tetragonal beam. Rods extended from the beam slidingly engage raised ridges in a metal roof panel, typically at a roof ridge or at any other open-ended roof panel. A closed rounded end of a u-loop is permanently affixed to the tetragon beam and faces downwardly toward the metal roof panel. Objects, equipment and people can be linked to the u-loop to prevent falling.

4 Claims, 5 Drawing Sheets

METAL ROOF SAFETY ANCHOR DEVICE

BACKGROUND OF THE INVENTION

Various types of roof safety anchor devices are known in the prior art. Most known devices require invasive attachment to a roof or to a roof structure. Many require two spaced apart roof connections, such as those that involve fastening to both the roof ridge and to the roof eve for example. Some anchor devices are much more suited to wood and shingle roofs and poorly suited, if at all, to metal roof construction. What has been needed is a metal roof safety anchor device that is noninvasively attached, leaves no marks or flaws in or on the roof or roof structure, is unitarily constructed, and is affixed and removed without fasteners. The present metal roof safety anchor device addresses these needs.

FIELD OF THE INVENTION

The present metal roof safety anchor device relates to apparatuses that provide for safely attaching people, tools, and equipment to a roof such that dropping and falling are negated, and more especially to a one piece metal roof safety anchor device that is non-invasively and selectively attached to and removed from a metal roof during construction and repair.

SUMMARY OF THE INVENTION

The general purpose of the metal roof safety anchor device, described subsequently in greater detail, is to provide a metal roof safety anchor device that has many novel features that result in a metal roof safety anchor device which is not anticipated, rendered obvious, suggested, or even implied by prior art, either alone or in combination thereof.

To accomplish this, the metal roof safety anchor device has a substantially tetragonal beam having a first end and a second end spaced apart from the first end, a top side and a partially open bottom side spaced apart from the top side, a first side and a second side spaced apart from the first side. The second side has a length greater than a length of the first side.

A plurality of rods is provided. Each rod has a proximal end and a distal end spaced apart from the proximal end. The proximal end is disposed through the second side and affixed to the second side and the first side.

A u-loop is provided. The u-loop has an open end spaced apart from a closed rounded end. The u-loop further has a pair of spaced apart legs disposed between the open end and the closed rounded end. Each leg has a first portion disposed adjacent the open end and a second portion disposed adjacent the closed rounded end. A bend is disposed in each leg most proximal the open end. The bend separates the first end from the second end. The first portion is affixed to the top side. The second portion is parallel to the rods.

In use, the rods extended from the second side slidingly engage a plurality of open raised ridges of a metal roof panel at a roof ridge or at any other open-ended roof panel, with the closed rounded end of the u-loop facing downwardly toward the metal roof panel. The beam therein abuts an upper end of the metal roof panel that is fastened to a roof or roof structure. The device is then securely supported. Existing ropes, lanyards, tie straps, and any appropriate item is used to anchor to a person, equipment, parts, and other objects to prevent their falling.

Thus has been broadly outlined the more important features of the present metal roof safety anchor device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
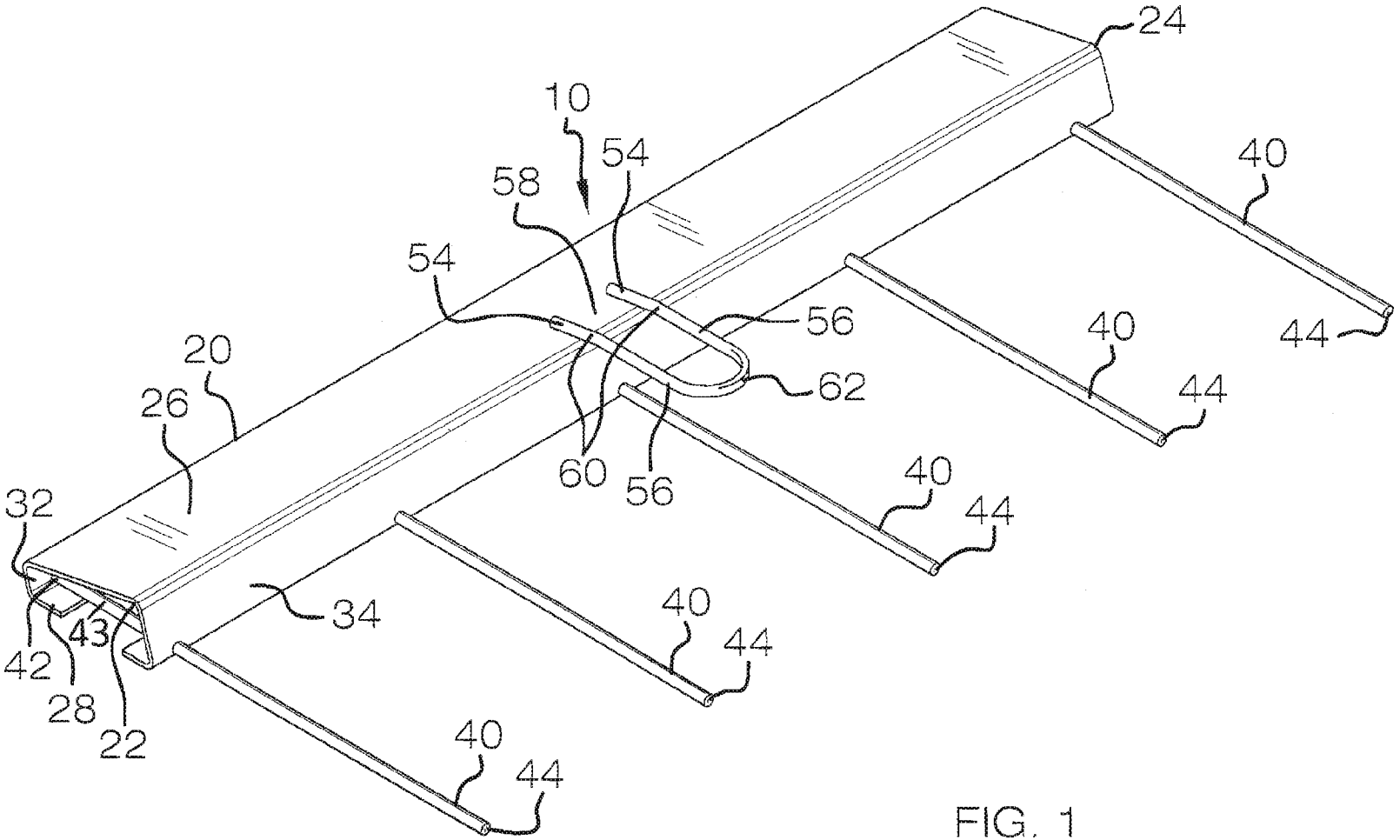
FIG. 1 is a perspective view.
Figure 2:
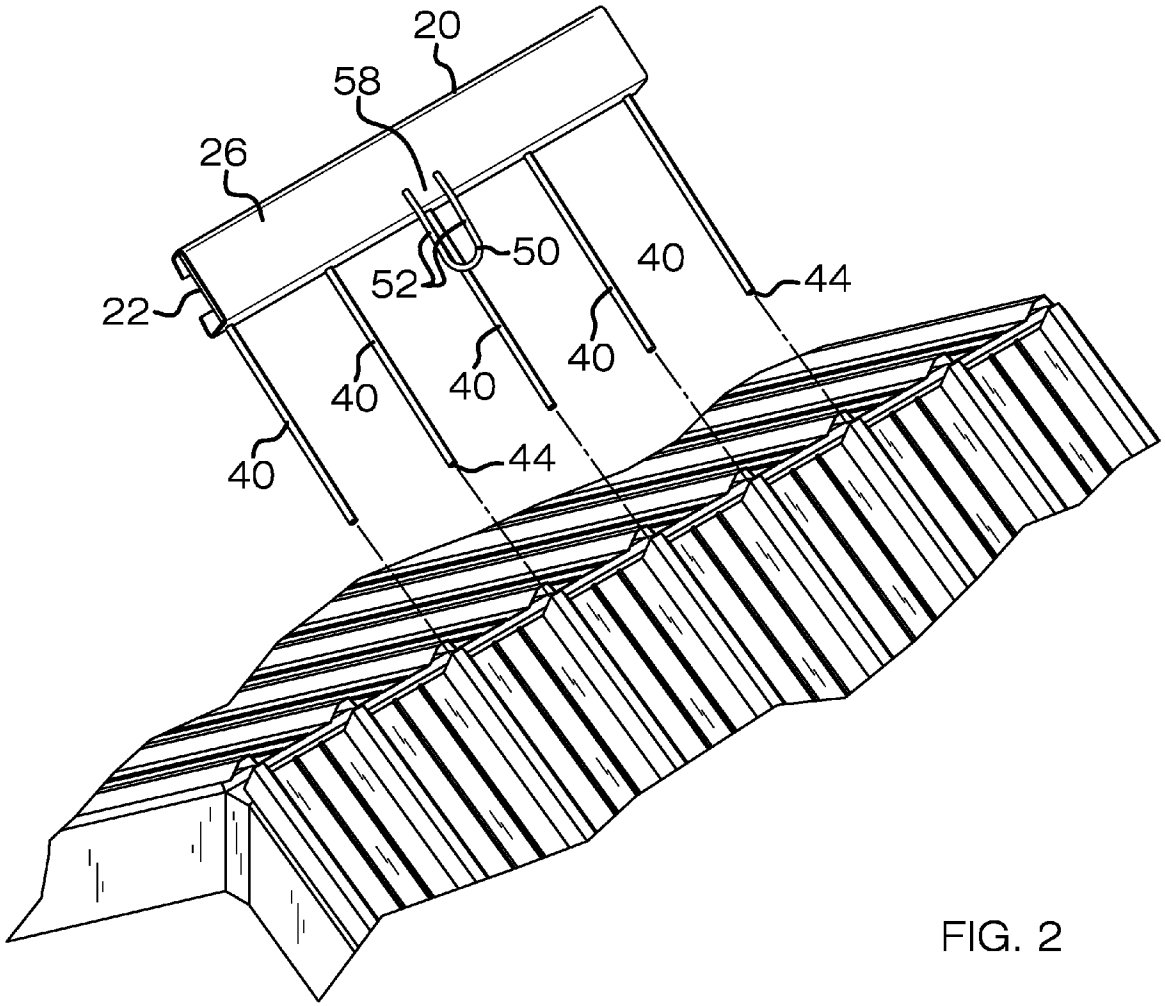
FIG. 2 is an exploded perspective view.
Figure 3:
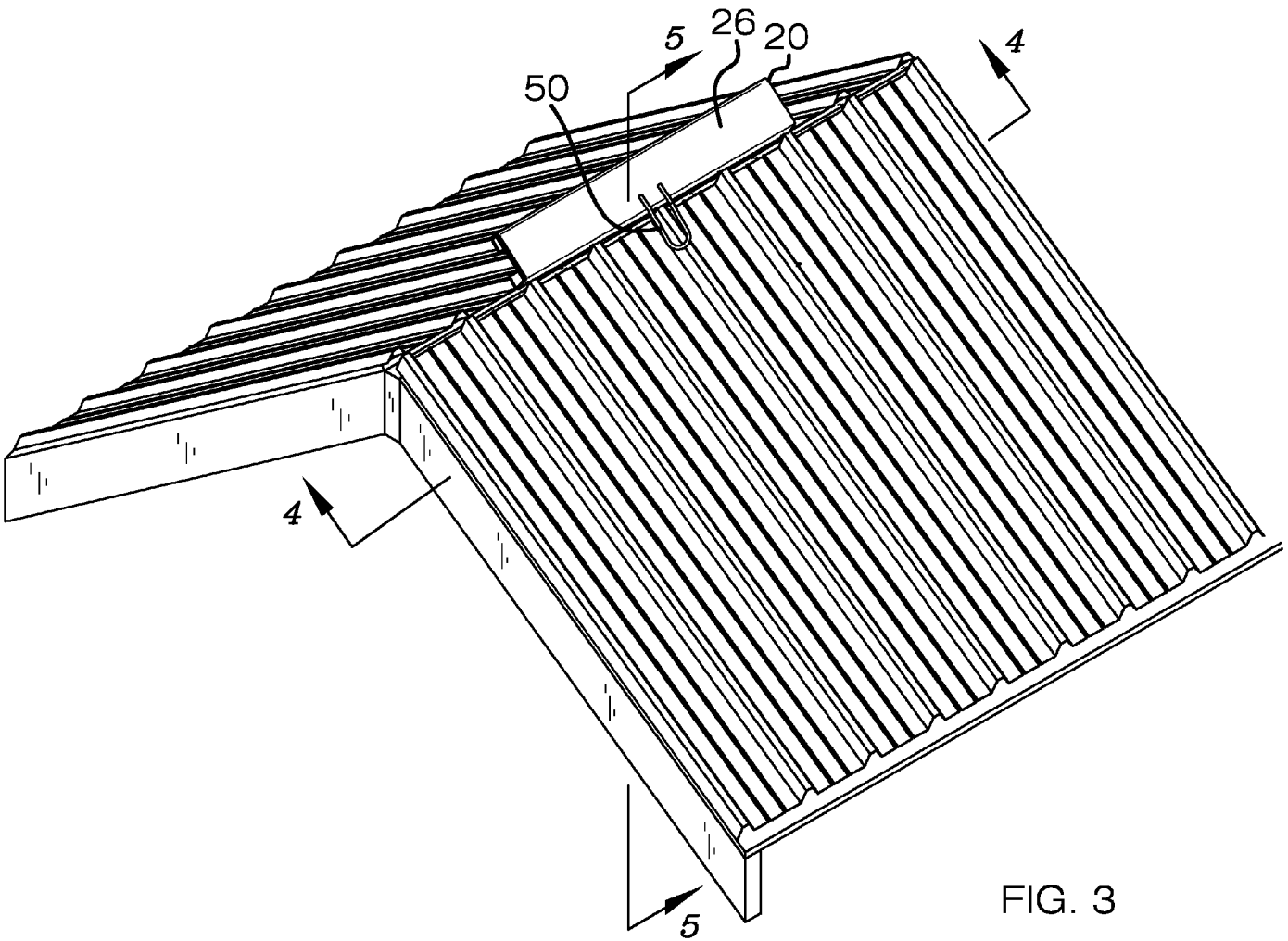
FIG. 3 is an in use view.
Figure 4:
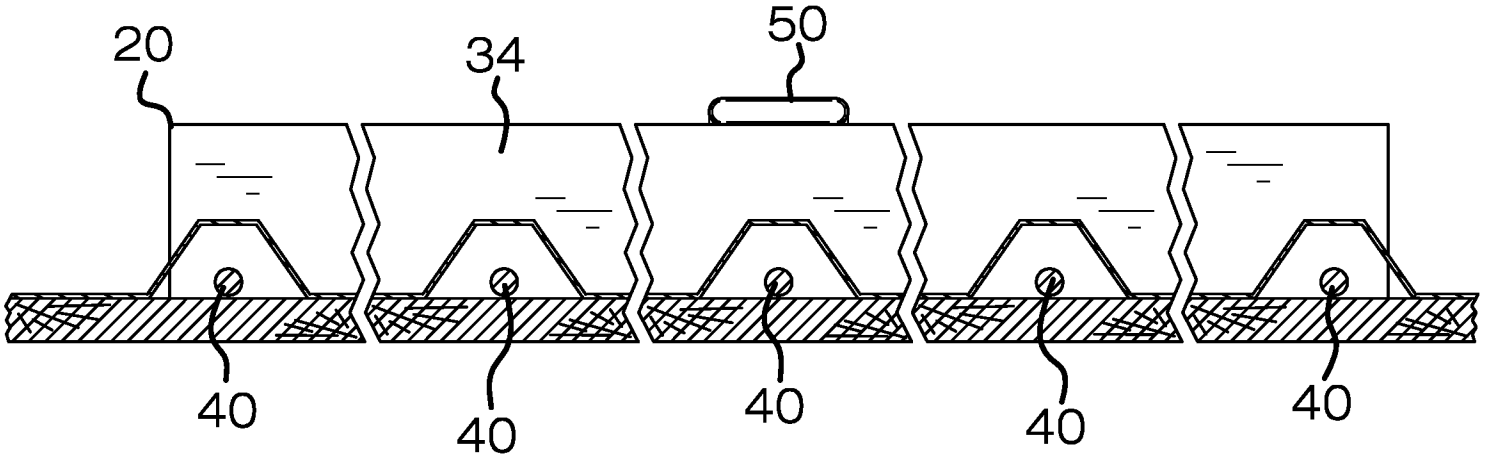
FIG. 4 is a cross sectional view of FIG. 3 taken along line 4-4.
Figure 5:
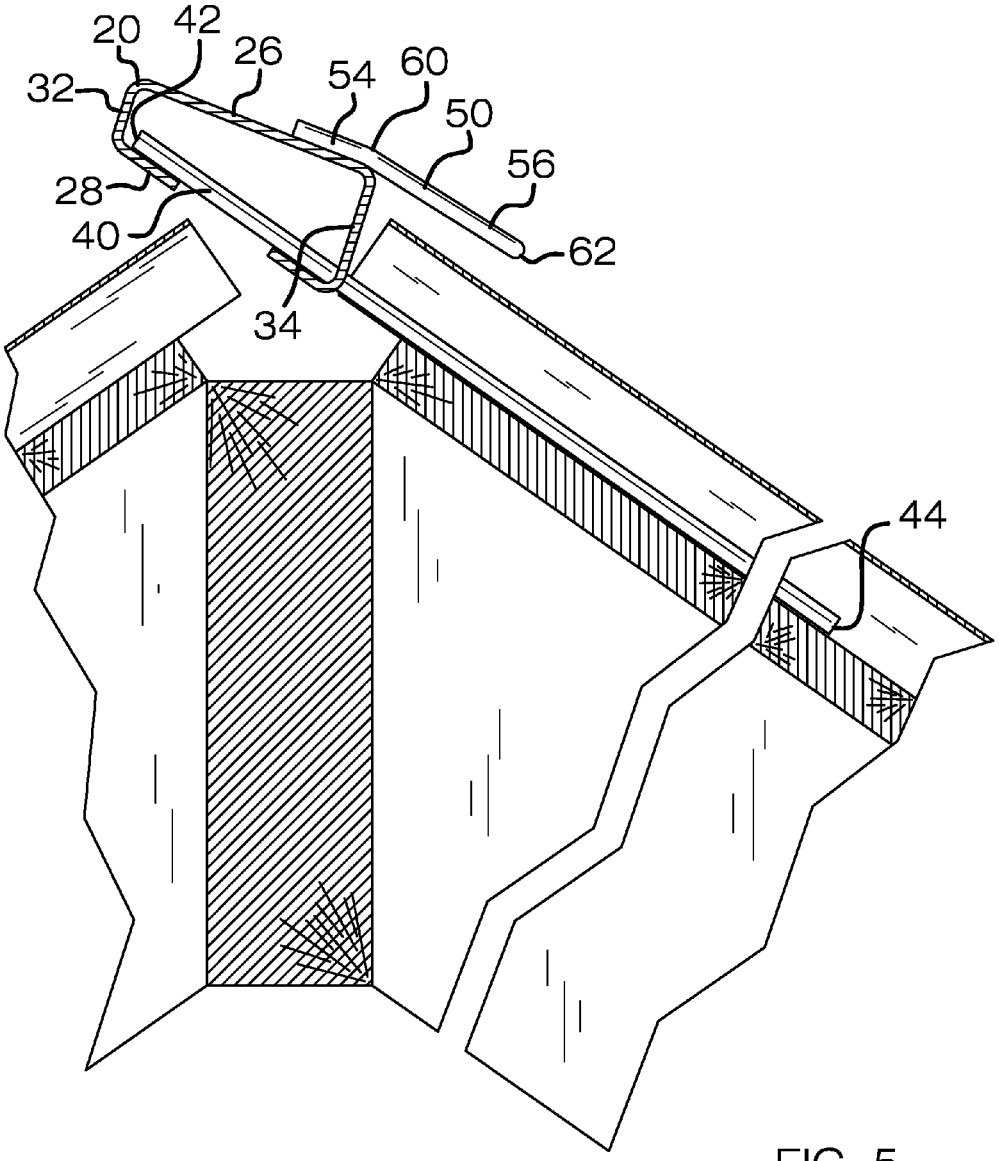
FIG. 5 is a cross sectional view of FIG. 3 taken along line 5-5.

With reference now to the drawings, and in particular FIGS. 1 through 5 thereof, an example of the metal roof safety anchor device employing the principles and concepts of the present metal roof safety anchor device and generally designated by the reference number 10 will be described.

Referring to FIGS. 1 through 5, the metal roof safety anchor device 10 has a substantially tetragonal beam 20 having a first end 22 and a second end 24 spaced apart from the first end 22, a top side 26 and a partially open bottom side 28 spaced apart from the top side 26, a first side 32 and a second side 34 spaced apart from the first side 32. The second side 34 has a length greater than a length of the first side 32.

A plurality of rods 40 is provided. Each rod 40 has a proximal end 42, a distal end 44 spaced apart from the proximal end 42, and a central portion 43 between the proximal end 42 and the distal end 44. The proximal end 42 is disposed through the second side 34 and is affixed to the first side 32. A portion of the central portion 43 is disposed within the beam 20 between the first side 32 and the second side 34 in a position across the open bottom side 28.

A u-loop 50 is provided. The u-loop 50 has an open end 58 spaced apart from a closed rounded end 62. The u-loop 50 further has a pair of spaced apart legs 52 disposed between the open end 38 and the closed rounded end 62. Each leg 52 has a first portion 54 disposed adjacent the open end 58 and a second portion 56 disposed adjacent the closed rounded end 62. A bend 60 spaces apart the first portion 54 from the second portion 56. The bend 60 is disposed in each leg most proximal the open end. The first portion 54 is affixed to the top side 26. The second portion 56 is parallel to the rods 40 and therefore an existing roof.

What is claimed is:

1. A safety anchor device attachable to a metal roof, the safety anchor device comprising:

a substantially tetragonal beam having a first end, a second end spaced apart from the first end, a top side, an open bottom side spaced apart from the top side, a first side, and a second side spaced apart from the first side;

a plurality of rods, each rod having a proximal end, a distal end spaced apart from the proximal end, and a central portion between the proximal end and the distal end, the proximal end disposed through the second side, and affixed to the first side, a portion of the central portion disposed within the beam between the first side and the second side in a position across the open bottom side; and a u-loop having an open end, a closed rounded end spaced apart from the open end, a pair of spaced apart legs disposed between the open end and the closed rounded end, each leg having a first portion disposed adjacent the open end and a second portion disposed adjacent the closed rounded end, a bend separating the open end and the closed end, the bend disposed in each lea more proximal the open end than the closed rounded end, the first portion permanently affixed to the top side;

wherein the distal end of each of the rods is configured to be inserted respectively into an open ridge of a metal roof panel facing a roof ridge thereby allowing attachment to the u-loop of the device to prevent falling of equipment or people.

2. The device of claim 1 wherein the second side has a length greater than a length of the first side.

3. The device of claim 1 where the second portion is disposed substantially parallel to the rods.

4. The device of claim 2 where the second portion is disposed substantially parallel to the rods.

* * * * *